United States Patent [19]

Lichfield

[11] 4,109,873

[45] Aug. 29, 1978

[54] GRINDING MILL

[76] Inventor: William H. Lichfield, P.O. Box 112, Corinne, Utah 84307

[21] Appl. No.: 709,812

[22] Filed: Jul. 29, 1976

[51] Int. Cl.[2] ..... B02C 23/28

[52] U.S. Cl. ..... 241/56; 241/248; 241/259.1

[58] Field of Search ..... 241/55, 56, 248, 257 R, 241/259.1, 261.2

[56] References Cited

U.S. PATENT DOCUMENTS

| | | | |
|---|---|---|---|
| 1,764,700 | 6/1930 | Spielman | 241/257 R |
| 2,563,768 | 8/1951 | Wood | 241/248 |
| 2,727,695 | 12/1955 | Harries | 241/56 |
| 2,852,202 | 9/1958 | Ditting et al. | 241/257 R |
| 2,858,083 | 10/1958 | Shurts | 241/257 R |
| 3,488,008 | 1/1970 | Bodine | 241/49 |
| 3,921,919 | 11/1975 | Zimmer | 241/56 |

*Primary Examiner*—Granville Y. Custer, Jr.
*Attorney, Agent, or Firm*—B. Deon Criddle

[57] ABSTRACT

A grinding mill having a feeding chamber for directing grain between grinding stones where it is ground into flour and from where it is discharged into a turbine chamber. Means are provided for directing cooling air into the turbine chamber, across the rotating grinding stone, and centrifugally out of the housing through a tangential discharge nozzle. The relative position of the grinding stones is easily varied by using a control handle to move the drive shaft of the motor, on which the rotating grinding stone is mounted. The position of the control handle is fixed by wedging it to a portion of the mill housing.

9 Claims, 4 Drawing Figures

GRINDING MILL

BRIEF DESCRIPTION OF THE INVENTION

1. Field of the Invention

This invention relates to grinding mills, and is particularly concerned with mills of the type that are adapted for home use.

2. Prior Art

It has become increasingly popular to grind cereal grains, and the like, at home. This allows the home user to have freshly ground flour for use in baking, and the like, and to have freshly ground cereals and other desired products. A great many grinding devices have been developed for home use, and many of them are very suitable for grinding grains and the like. One such grinding mill is shown, for example, in U.S. Pat. No. 3,488,008, wherein grain to be milled is placed into a hopper on top of the machine and from there moves into a grinding chamber between a fixed grinding stone and a rotating grinding stone. The grain is ground into flour and is discharged peripherally from the grinding chamber before being entrained in air that is pulled into the housing by turbine blades and that is tangentially discharged. It has been found, however, that the mill of the aforesaid patent does not adequately cool the flour being ground and, the heat generated acts with the moisture in the grain to frequently ball up the grain such that it clogs the grain intake to the stones and causes flour to cake on the grinding surfaces of the stones. Additional clogging results from the straight discharge nozzle, which tends to allow the flour to settle as its velocity is decreased. In addition, the aforesaid mill is difficult to adjust to change the courseness of flour ground.

SUMMARY OF THE INVENTION

Principal objects of the present invention are to provide a mill that will better cool flour as it is ground; that will provide for easy adjustment between grinding stones so that the courseness of the ground flour can be set as desired; and that is less subject to clogging than turbine mills heretofore known.

Principal features of the invention include the central air feed whereby the rotating grinding stone and the flour being ground are constantly cooled during operation; the motor cooling obtained by providing air vents in the motor housing; and the adjustment means providing for adjustment of the motor shaft relative to the motor to thereby move the rotating grinding stone relative to the fixed grinding stone.

Still other features include plural adjustment means for setting grinding stone spacing and easily operated means for adjusting and locking such adjustment means.

Further objects and features of the invention will become apparent from the following detailed description taken together with the accompanying drawing, disclosing what is presently contemplated as being the best mode of the invention.

THE DRAWING

In the drawing:

FIG. 1 is a perspective view of the grinding mill of the invention;

FIG. 2, a vertical section view taken on the angled line 2—2 of FIG. 1;

FIG. 3, a bottom plan view of the baffle plate; and

FIG. 4, a bottom plan view of the adjustment plug and handle.

DETAILED DESCRIPTION

Figure 1:
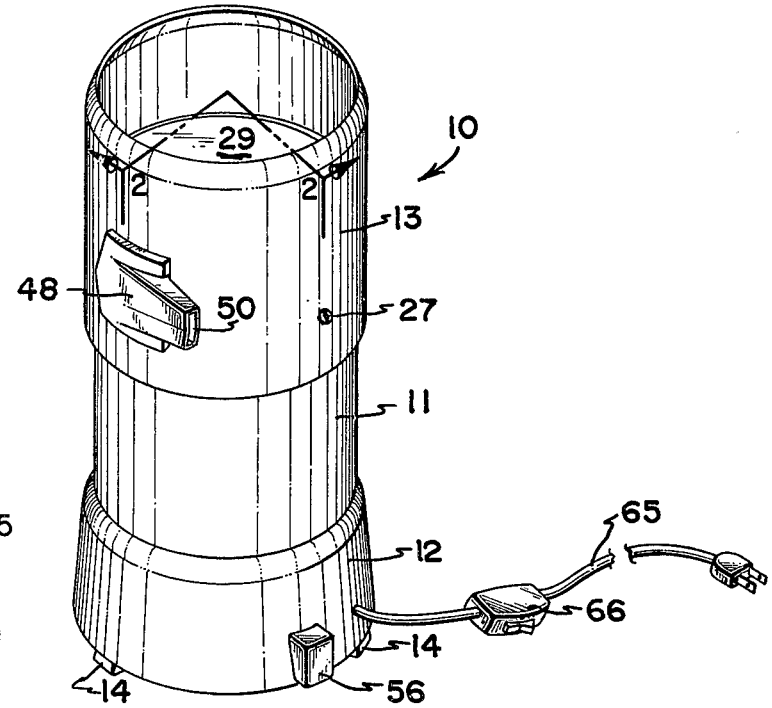

Referring now to the drawings:

In the illustrated preferred embodiment, the grinding mill 10, includes a motor housing 11, a flared skirt 12, pressed onto and glued or otherwise attached to a lower end of the motor housing and extending downwardly and outwardly therefrom, and a hopper 13.

A plurality of legs 14 are wedged between the lowermost portion of the motor housing 11 and the skirt 12 and the legs are preferably equally spaced around the housing. The wedging of the legs helps to prevent the skirt from moving up and down with respect to the housing and the legs are also securely glued or otherwise affixed to the housing.

A rubber foot 15 is attached to the bottom of each leg 14 to serve as a cushion and to prevent undesired sliding of the mill.

An electric motor 16 is positioned within the housing 11, with the motor shaft 17 projecting upwardly through a bearing 18 and an opening 19 in the top of the housing and downwardly through a bearing 20 in a boss 21 formed at the bottom of the housing.

Boss 21 is interiorly threaded to receive a threaded plug 22 on which the shaft 17 rests. A washer 23 on plug 22 surrounds the shaft 17 and supports another washer 24 that fits beneath the outer race of the bearing 20. As the plug 22 is threaded into and out of the boss 21 the motor shaft 17 is raised or lowered through the motor 16. Bearing 20 is simultaneously raised or lowered with the shaft 17, so that rotational movement of the inner race of the bearing with the shaft 17 is not affected by stone adjustment, even though such adjustment is performed while the mill is operated.

A baffle plate 24, having downwardly projecting, spaced bosses 25 rests on the top of the motor housing 11. Screws 26, inserted through the bosses and threaded into the top of the housing 11 secure the baffle plate to the motor housing and screws 27, spaced around the hopper 13 extend through the hopper and into the bosses 25 to secure the hopper to the baffle plate and with respect to the housing 11.

The hopper 13 includes an outer wall that extends downwardly at 28 below the top of the motor housing and that is spaced from the motor housing. A hopper plate 29 is press-fitted or otherwise affixed inside the hopper 13, a spaced distance above the baffle plate 24. The hopper plate 29 has a central grain feed opening 30 and is generally concave upwardly. A ring shaped non-rotating grinding stone 31 surrounds the grain feed opening 30 and is fixed to the bottom of the hopper plate. A concave grinding surface of the stone faces downwardly and the outer edge of the stone is then arranged to cooperate in a grinding relationship with the outer edge of a rotating grinding stone 32. The upper face of the rotating grinding stone provides a cooperating grinding surface and the outer edge thereof has radially extending slots (not shown), through which ground grain is peripherally discharged, as will be hereinafter further described.

The rotating grinding stone is glued or otherwise affixed to a backing member 33 that also has outwardly and vertically extending turbine blades 34 affixed thereto. The backing member 33 is fixed to a hollow shaft **34*a*** that is telescoped over the end of motor shaft 17 and a cap 35 closes the end of the hollow shaft 34*a* to keep grain and the like from falling thereinto.

Motor shaft 17 and the hollow shaft 34*a* have keyways 36 and 37 respectively formed therein and a key 38 inserted into the keyways fixes the hollow shaft and the backing member, grinding stone and blades affixed thereto to the motor shaft 17 for rotation therewith.

A set screw 39 through the hollow shaft 34*a* and tightened into key 38 prevents vertical movement of the hollow shaft on the motor shaft.

Figure 3:
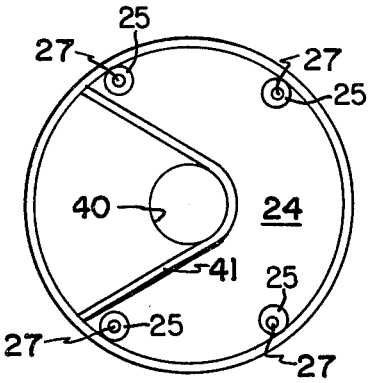
Figure 2:
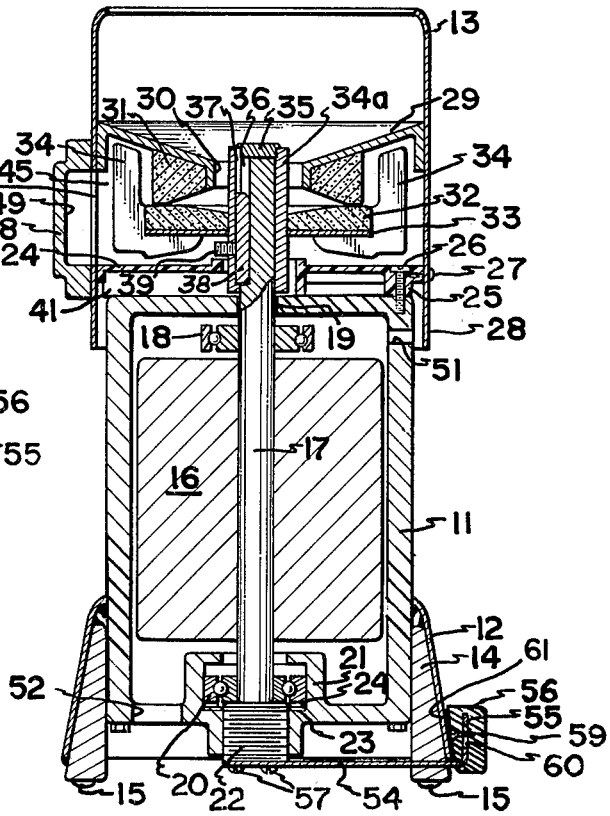

As best seen in FIG. 3, baffle plate 24 has a central opening 40 therethrough and a wall 41 projecting downwardly therefrom to engagement with the top of the motor housing 11, FIG. 2. The wall 41 curves around the opening 40 and extends angularly outwardly from the opening to define a quadrant of the plate. The opening 40 is larger than the motor shaft 17 and the hollow shaft 34*a*. Air entering between the motor housing 11 and the hopper 13 and within the quadrant defined by wall 41 is passed upwardly through the opening 40 and into the space formed within the hopper 13 and between the baffle plate 24 and the hopper plate 29.

The space between the baffle plate 24 and the hopper plate 29, within the hopper 13 comprises a turbine chamber 45 within which the turbine blades 34 are rotated as the motor shaft is turned.

The air entering the turbine chamber 45, through the opening 40 passes beneath the backing member 33, cooling the backing member and the grinding stone attached thereto and is moved around the periphery of chamber 45. As the air is moved around the periphery of the chamber 45 it entrains the flour resulting from grain being dumped between the stones and ground as it is discharged from the slots radiating to the peripheries of the stones. The slotted stones, while not shown in detail, are well known, and any such commercially available stones can be used.

After the flour has been entrained, the air and flour are discharged from the chamber 45 through an opening 47 in the side wall of the hopper 13 and through a tangentially extending discharge spout 48. The spout 48 has a large inlet opening 49 (FIG. 2), and is smoothly and gradually tapered to a smaller outlet opening 50 (FIG. 1). This constantly decreasing opening of the discharge spout results in an increasing pressure as air and flour are forced therethrough. It has been found that the increasing pressure reduces the tendency of the spout to clog with flour being discharged therethrough.

The air moving across the backing member cools the rotating grinding stone and the grain being ground. This decreases stone wear and decreases clogging in the machine.

Air moving between the hopper 13 and motor housing 11 also circulates through openings 51, spaced around the upper end of motor housing 11, past the motor 16, and out openings 52 in the bottom of the motor housing. This air thus serves to cool the motor and to prolong the life thereof.

Figure 4:
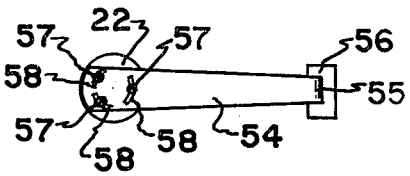

A handle 54 is attached to the bottom of plug 22 and extends outwardly therefrom, between a pair of legs 14, and beyond the flared skirt 12, where it is upturned at 55 to receive a lock member 56. The handle 54 is attached to plug 22 by screws 57 inserted through arcuate slots 58 (FIG. 4) and threaded into the plug.

The lock member 56 comprises a block that is mounted to slide up and down on the upturned portion 55 of handle 54. A screw 59 through the block and through a slot 60 in the upturned portion keeps the lock member 56 from coming off the handle.

The lock member has a face 61 that is curved to conform to the curvature of the skirt 12 and that is angled to correspond with the flare of the skirt. Thus, when the lock member is raised on the upturned portion 55 the handle is freely rotated between legs 14. Such rotation turns plug 22 and raises or lowers the motor shaft 17, as previously described and allows for precise adjustment of the distance between the fixed grinding stone 31, and the rotating grinding stone 32, carried by the motor shaft. If still further adjustment is required to properly position the stones, as for example may be necessary if the stones have become excessively worn, screws 57 can be loosened and the position of the handle 56 can be changed relative to plug 22. Thereafter, the screws 57 can be tightened and movement of the handle will again move plug 22 to change the position of the rotating grinding stone 32 relative to the fixed grinding stone 31.

When the handle 46 is set at a desired position it is securely locked in place merely by pushing down on the lock member to thereby wedge it tightly against the skirt.

In operation, grain or the like, is placed in the top of hopper 13, on top of hopper plate 29. The power cord 65 of the motor is plugged in and switch 66 is operated to start the motor. This rotates the motor shaft 17 and the grinding stone 32 and blades 34 attached thereto. The grain is gravity fed through opening 30 in the hopper plate and between the two stones. The ground flour is entrained by air entering chamber 46 from opening 40 and is discharged through discharge spout 40 to be caught in a bag or other suitable container.

The degree of courseness of the ground flour can be determined by setting of handle 54.

Although a preferred form of my invention has been herein disclosed, it is to be understood that the present disclosure is made by way of example and that variations are possible without departing from the subject matter coming within the scope of the following claims, which subject matter I regard as my invention.

I claim:

1. A grinding mill having a hopper;

a hopper plate in the hopper, said hopper plate having an opening through which grain or the like is fed from the hopper;

a fixed grinding stone beneath the hopper plate and having a downwardly facing grinding surface;

a motor housing;

a motor in said housing;

a motor shaft driven by said motor and extending upwardly therefrom;

a rotating grinding stone having an upwardly facing grinding surface carried by said motor shaft, said grinding surfaces of said fixed and rotating grinding stones being in face-to-face relationship, with a grinding chamber therebetween;

turbine blades rotatable with said rotating grinding stone;

means including a baffle plate in the hopper and spaced from the hopper plate and a wall projecting downwardly from said baffle plate to direct air from between the motor housing and hopper centrally to the rotating grinding stone for supplying cooling air across the bottom of said rotating grinding stone to said turbine blades at the peripheries of said stones;

means mounting the hopper above the motor housing;

a discharge spout extending tangentially from said hopper beneath the hopper plate to receive said air and entrained flour ground between and discharged peripherally from said stones; and openings through the motor housing whereby air is circulated from outside the housing around the motor.

2. A grinding mill as in claim 1, further including a flared skirt member secured to a lower end of the motor housing and projecting dowwardly and outwardly therefrom; and a plurality of legs spaced around the motor housing and wedged between the motor housing and the skirt member, said legs projecting from beneath the skirt member to support the mill such that air can pass through the motor housing and beneath the skirt member, between the legs.

3. A grinding mill as in claim 2, further including adjustment means comprising a threaded plug, threaded into the motor housing and supporting the motor shaft; and a handle fixed to the plug and projecting outwardly of the housing whereby movement of the handle will move the motor shaft with respect to the motor to adjust the relative positions of the fixed and rotating stones.

4. A grinding mill as in claim 3, wherein the adjustment means further includes a lock member slidably mounted on an upturned portion of the handle and having a face angled to be wedged against the skirt member.

5. A grinding mill as in claim 1 wherein the baffle plate includes a downwardly extending wall engaging the motor housing and defining a quadrant of the baffle plate, and a central opening surrounding the motor shaft below the rotating grinding stone and within the quadrant; and wherein the motor housing is spaced from the hopper.

6. A grinding mill as in claim 1, wherein the discharge spout extends substantially tangentially from the hopper and has an intake opening and a smaller discharge opening, the size of said spout decreasing gradually between said openings.

7. A grinding mill having a hopper;

a hopper plate in the hopper, said hopper having an opening through which grain or the like is fed from the hopper;

a fixed grinding stone beneath the hopper plate and having a downwardly facing grinding surface;

a motor housing;

a motor in said housing;

means mounting the hopper above the motor housing;

a motor shaft extending through said motor and driven thereby;

a rotating grinding stone having an upwardly facing grinding surface carried by said motor shaft above the motor, said grinding surfaces of said fixed and rotating grinding stones being in face-to-face relationship;

turbine blades rotatable with said motor shaft around said fixed grinding stone;

a plug threaded into a bottom of the motor housing;

a bearing on the plug, said bearing journaling a lower end of the motor shaft projecting downwardly from the motor; and a handle fixed to the plug for turning of said plug, said handle projecting outwardly beyond the motor housing said handle having arcuate slots therein and including screws inserted through the arcuate slots into the plug, whereby the angular relationship of the handle to the plug is variable.

8. A grinding mill as in claim 7, further including a flared skirt member secured to a lower end of the motor housing and projecting downwardly and outwardly therefrom; and a plurality of legs spaced around the motor housing and wedged between the motor housing and the skirt member with said handle extending between a pair of said legs, said legs projecting from beneath the skirt member to support the mill.

9. A grinding mill as in claim 8, wherein the adjustment means further includes a lock member slidably mounted on an upturned portion of the handle and having a face angled to be wedged against the skirt member.

* * * * *